US010065721B1

(12) United States Patent
Girard et al.

(10) Patent No.: US 10,065,721 B1
(45) Date of Patent: Sep. 4, 2018

(54) PERSONAL WATERCRAFT FOOTRESTS

(71) Applicant: BOMBARDIER RECREATIONAL PRODUCTS INC., Valcourt (CA)

(72) Inventors: Etienne Girard, Eastman (CA); Jonathan Belanger, Waterloo (CA); Julien Hardy-Pare, Bromont (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 0 days.

(21) Appl. No.: 15/419,317

(22) Filed: Jan. 30, 2017

Related U.S. Application Data

(60) Provisional application No. 62/288,856, filed on Jan. 29, 2016.

(51) Int. Cl.

| | |
|---|---|
| ***B63H 25/46*** | (2006.01) |
| ***B63H 11/04*** | (2006.01) |
| ***B63B 17/00*** | (2006.01) |
| ***B63B 35/73*** | (2006.01) |

(52) U.S. Cl.
CPC ..... *B63H 11/04* (2013.01); *B63B 17/00* (2013.01); *B63B 35/731* (2013.01); *B63H 25/46* (2013.01); *B63B 2751/00* (2013.01); *B63H 2025/465* (2013.01)

(58) Field of Classification Search
CPC ..... B63H 11/04; B63B 35/731
USPC ..... 114/55
See application file for complete search history.

(56) References Cited

U.S. PATENT DOCUMENTS

| | | | | |
|---|---|---|---|---|
| 7,699,010 | B2 * | 4/2010 | Spade | B63B 35/731 114/364 |
| 7,748,334 | B2 * | 7/2010 | Ross | B63B 35/731 114/55.57 |
| 7,856,937 | B2 * | 12/2010 | Chapdelaine | B63H 11/00 114/125 |
| 8,245,657 | B2 * | 8/2012 | Ross | B63B 35/731 114/55.53 |
| 8,555,799 | B2 * | 10/2013 | Otsuka | B63B 35/731 114/364 |
| 9,517,826 | B1 * | 12/2016 | Leblond | B63H 21/21 |
| 2009/0107377 | A1 * | 4/2009 | Duquette | B63B 35/731 114/55.57 |
| 2009/0107380 | A1 * | 4/2009 | Duquette | B63B 35/731 114/55.57 |
| 2009/0139437 | A1 * | 6/2009 | Simard | B63B 35/731 114/55.57 |

(Continued)

*Primary Examiner* — S. Joseph Morano
*Assistant Examiner* — Jovon Hayes
(74) *Attorney, Agent, or Firm* — BCF LLP

(57) ABSTRACT

A personal watercraft has a hull and a deck. The hull defines at least in part a tunnel. A ride plate is connected to the hull and defines a bottom wall of the tunnel. The personal watercraft also has a motor, a jet propulsion system disposed at least in part in the tunnel, and a steering assembly. The deck has a pedestal, left and right gunnels, left and right foot-wells disposed laterally between the pedestal and their respective gunnel, and a rear platform. A straddle seat is disposed on the pedestal. Left and right footrests have left and right standing surfaces facing substantially forward and extending at least partially forward of the tunnel. The left footrest extends laterally between the pedestal and the left gunnel. The right footrest extends laterally between the pedestal and the right gunnel.

20 Claims, 12 Drawing Sheets

(56) References Cited

U.S. PATENT DOCUMENTS

2009/0158982 A1* 6/2009 Ross ..... B63B 25/002
114/55.57
2009/0194010 A1* 8/2009 Spade ..... B63B 35/731
114/55.57

* cited by examiner

PERSONAL WATERCRAFT FOOTRESTS

CROSS-REFERENCE

The present application claims priority to U.S. Provisional Patent Application No. 62/288,856, filed Jan. 29, 2016, entitled "PERSONAL WATERCRAFT FOOTRESTS", the entirety of which is incorporated herein.

FIELD OF TECHNOLOGY

The present technology relates to footrests and footrests for a personal watercraft.

BACKGROUND

In order to make a personal watercraft (PWC) better suited for wakeboarding and waterskiing, some PWC now include features specifically designed for these sports. Some PWC now have racks to hold a wakeboard or water skis. Some PWC have tow poles which provide a higher attachment point for a tow rope and the tow hooks for towing a wakeboarder and/or a water skier via the tow rope.

However, in recent years the PWC have been used not only for wakeboarding and waterskiing but also to perform new tricks and new manoeuvres therewith. For example, when riding a PWC, one trick involves pulling the bow out of the water, orienting the PWC almost vertically such that the jet pump thrust is directed downwards and all but the stern of the PWC is lifted out of the water. A skilled operator can keep the PWC in this position for an extended period of time, leaning the PWC forward just enough to maintain a substantially vertical position while travelling forward or turning. However, conventional foot-wells of PWC do not provide an adequate support for the operator while performing such maneuvers and prevent the operator to achieve new rider positions.

SUMMARY

The present technology may ameliorate at least some deficiencies of the prior art with respect to PWC.

In some implementations of the present technology, there is provided a personal watercraft. The personal watercraft has a hull defining at least in part a tunnel. The tunnel has a pair of side walls, a front wall and a top wall defined by the hull. The front wall is disposed forward of a transom of the hull. The personal watercraft has a ride plate connected to the hull, wherein the ride plate defines a bottom wall of the tunnel. The personal watercraft has a motor supported by the hull and a jet propulsion system connected to the hull and operatively connected to the motor. The jet propulsion system is disposed at least in part in the tunnel. The personal watercraft has a steering assembly operatively connected to the jet propulsion system and a deck disposed on the hull. The deck has a pedestal, a left gunnel disposed on a left side of the pedestal, a right gunnel disposed on a right side of the pedestal, a left foot-well disposed laterally between the pedestal and the left gunnel, a right foot-well disposed laterally between the pedestal and the right gunnel and a rear platform disposed at least in part rearward of the pedestal. The personal watercraft has a straddle seat disposed on the pedestal and at least in part rearward of the steering assembly. The personal watercraft has a left footrest which has a left standing surface facing substantially forward and extending at least partially forward of the tunnel. The left footrest extends laterally between the pedestal and the left gunnel. The personal watercraft has a right footrest which has a right standing surface facing substantially forward and extending at least partially forward of the tunnel. The right footrest extends laterally between the pedestal and the right gunnel.

In some implementations of the personal watercraft, a longest distance between a handlebar of the steering assembly and one of the left footrest and the right footrest is between 1.2 meters and 1.4 meters. The longest distance is measured along a line which extends downward and rearward from the handlebar to the one of the left footrest and the right footrest and wherein the line is parallel to a vertical plane passing through a longitudinal centerline of the watercraft.

In some implementations of the personal watercraft, the longest distance between a handlebar of the steering assembly and one of the left footrest and the right footrest is about 1.3 meters.

In some implementations of the personal watercraft, a first line normal to the left standing surface at a center thereof and a second line normal to the right standing surface at a center thereof extend above the steering assembly.

In some implementations of the personal watercraft, the left standing surface has a left upper edge and the right standing surface has a right upper edge. The left upper edge and the right upper edge are disposed forward of the tunnel.

In some implementations of the personal watercraft, the left standing surface and the right standing surface are disposed entirely forward of the tunnel.

In some implementations of the personal watercraft, the left footrest has a right vertically extending side and a left vertically extending side, wherein the right vertically extending side is taller than the left vertically extending side, and wherein the right vertically extending side of the left footrest extends along the pedestal. Also, in some implementations of the personal watercraft, the right footrest has a right vertically extending side and a left vertically extending side, wherein the left vertically extending side is taller than the right vertically extending side, and wherein the left vertically extending side of the right footrest extends along the pedestal.

In some implementations of the personal watercraft, the left standing surface is disposed entirely laterally inward of the left gunnel and the right standing surface is disposed entirely laterally inward of the right gunnel.

In some implementations of the personal watercraft, the left standing surface and the right standing surface are longitudinally aligned with a water intake ramp, wherein the water intake ramp is disposed forward of the front wall of the tunnel.

In some implementations of the personal watercraft, at least a portion of the left standing surface and at least a portion of the right standing surface are longitudinally aligned with a water inlet.

In some implementations of the personal watercraft, the left standing surface and the right standing surface are at an angle between 45 degrees and 70 degrees from a waterline.

In some implementations of the personal watercraft, the left standing surface and the right standing surface are at an angle of about 60 degrees.

In some implementations of the personal watercraft, the left standing surface and the right standing surface are at an angle of between 65 degrees and 90 degrees from the rear platform.

In some implementations of the personal watercraft, the straddle seat has an operator seating portion and a passenger seating portion.

In some implementations of the personal watercraft, the left standing surface is at an angle between 35 degrees and 65 degrees from a central portion of the left foot-well and wherein the right standing surface is at an angle between 35 degrees and 65 degrees from a central portion of the right foot-well.

In some implementations of the personal watercraft, the left standing surface and the right standing surface are disposed at least in part forward of the rear platform.

In some implementations of the personal watercraft, the left foot-well has a central portion and a rear portion, wherein the rear portion extends upward and rearward from the central portion to the left footrest. The left standing surface is disposed longitudinally between the rear portion of the left foot-well and the rear platform. The right foot-well has a central portion and a rear portion, wherein the rear portion extends upward and rearward from the central portion to the right footrest. The right standing surface is disposed longitudinally between the rear portion of the right foot-well and the rear platform.

In some implementations of the present technology, there is provided a footrest for a personal watercraft, wherein the footrest is adapted for connection to a foot-well of the personal watercraft. The footrest has a footrest body which has a base adapted for connecting the footrest body to the foot-well and a front face defining a standing surface. The footrest body has a first vertically extending side and a second vertically extending side. The second vertically extending side is disposed opposite to the first vertically extending side. The first vertically extending side is taller than the second vertically extending side. The first vertically extending side extends at least in part laterally outwardly from the base. The first vertically extending side and the second vertically extending side are generally triangular.

In some implementations of the footrest, the standing surface has a largest straight diagonal dimension between 0.2 meters and 0.25 meters.

In some implementations of the footrest, the standing surface has a straight line width between 0.075 meters and 0.125 meters measured through a center thereof.

In some implementations of the footrest, the standing surface has a straight line length between 0.15 meters and 0.19 meters measured through a center thereof.

For purposes of this application, terms related to spatial orientation such as forwardly, rearward, upwardly, downwardly, left, and right, are as they would normally be understood by a driver of the vehicle sitting thereon in a normal riding position. Terms related to spatial orientation when describing or referring to components or sub-assemblies of the vehicle, separately from the vehicle, such as a hull for example, should be understood as they would be understood when these components or sub-assemblies are mounted to the vehicle, unless specified otherwise in this application. The term "straddle seat" refers to a seat on which a person normally sits astride. The term "motor" can refer to any component capable of driving the motion of a watercraft, which includes but is not limited to an internal combustion engine or an electric motor. Explanations and/or definitions of terms provided in the present application take precedence over explanations and/or definitions of these terms that may be found in the document incorporated herein by reference.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

It should also be noted that, unless otherwise explicitly specified herein, the drawings are not to scale.

DETAILED DESCRIPTION

The examples and conditional language recited herein are principally intended to aid the reader in understanding the principles of the present technology and not to limit its scope to such specifically recited examples and conditions. It will be appreciated that those skilled in the art may devise various arrangements which, although not explicitly described or shown herein, nonetheless embody the principles of the present technology and are included within its spirit and scope.

Furthermore, as an aid to understanding, the following description may describe relatively simplified implementations of the present technology. As persons skilled in the art would understand, various implementations of the present technology may be of a greater complexity.

In some cases, what are believed to be helpful examples of modifications to the present technology may also be set forth. This is done merely as an aid to understanding, and, again, not to define the scope or set forth the bounds of the present technology. These modifications are not an exhaustive list, and a person skilled in the art may make other modifications while nonetheless remaining within the scope of the present technology. Further, where no examples of modifications have been set forth, it should not be interpreted that no modifications are possible and/or that what is described is the sole manner of implementing that element of the present technology.

The following description relates to one possible way of manufacturing a personal watercraft (PWC) and a footrest therefor. Those of ordinary skill in the watercraft art will recognize that there are other known ways of manufacturing and designing watercraft and footrests.

Figure 1:
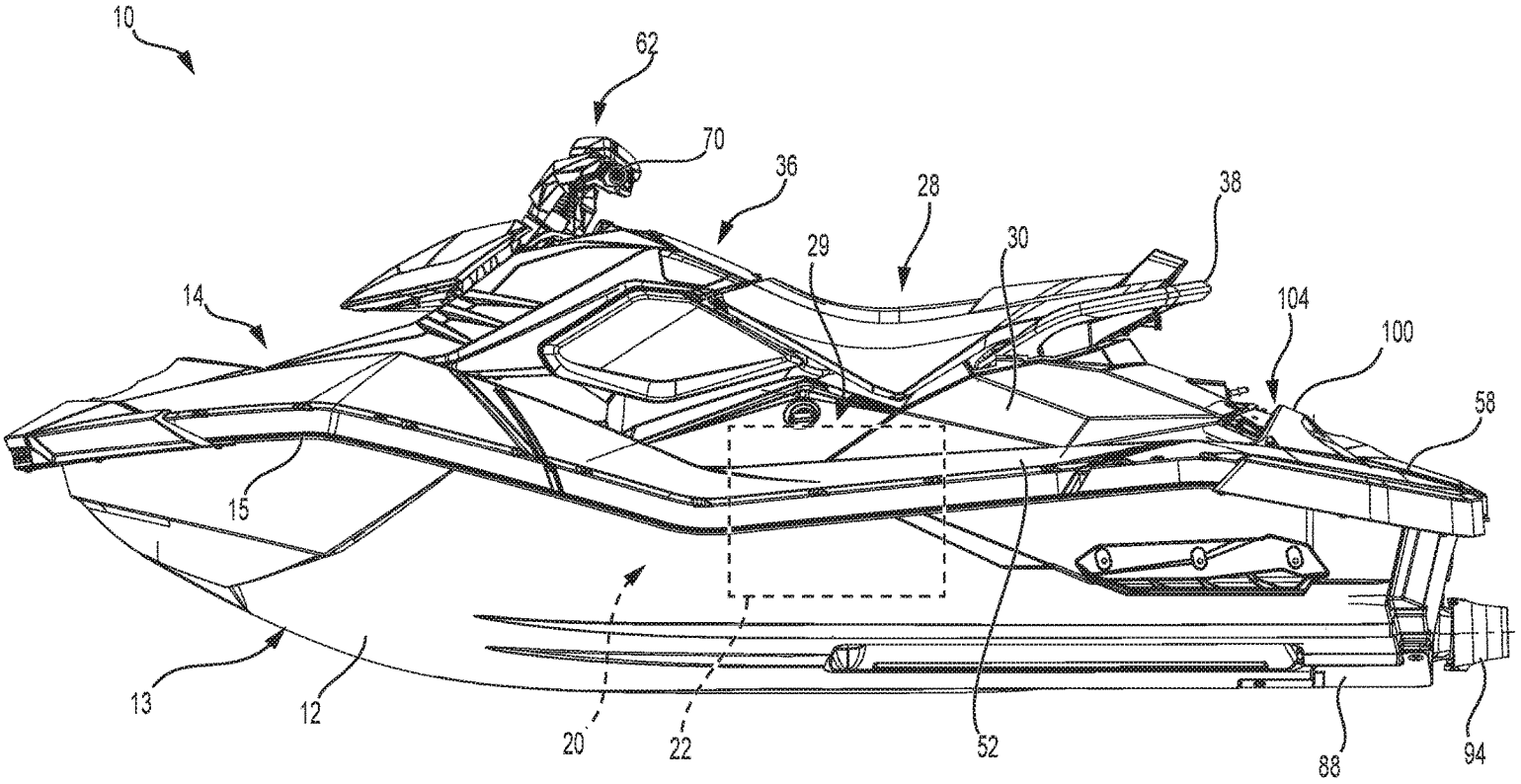
FIG. 1 is a left side elevation view of a personal watercraft (PWC)

The PWC 10 of FIG. 1 has a hull 12 and a deck 14 disposed on the hull 12. The hull 12 buoyantly supports the PWC 10 in the water. The deck 14 is designed to accommodate an operator and a passenger. An upper part of the hull 12 has an outwardly extending lip 15. A lower part of the deck 14 has a corresponding outwardly extending lip (not labelled) which is bonded or otherwise fastened to the lip 15 of the hull 12.

A space between the hull 12 and the deck 14 forms a volume commonly referred to as a motor compartment 20. The motor compartment 20 accommodates a motor 22 shown schematically in FIG. 1. In the present implementation, the motor 22 is an internal combustion engine 22, but other types of motors are contemplated without departing from the scope of the present technology. The motor compartment 20 also houses intake, exhaust, fuel, and electrical systems, and other elements required or desirable in the PWC 10. The engine 22 is supported in the hull 12 by a plurality of engine mounts (not shown).

Figure 2:
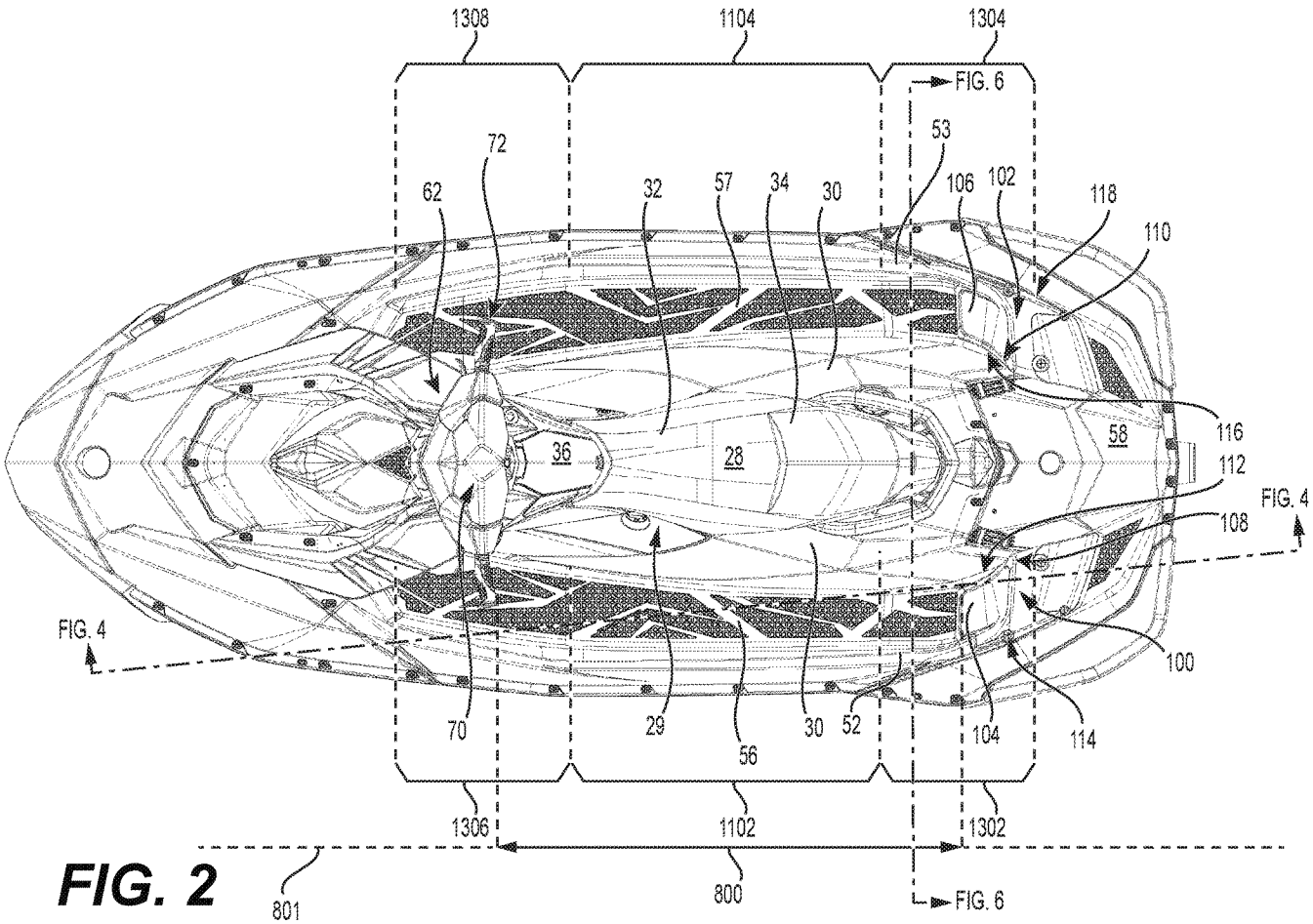
FIG. 2 is a top plan view of the PWC of FIG. 1.

As seen in FIGS. 1 and 2, the deck 14 has a centrally positioned straddle seat 28 positioned on top of a pedestal 30 to accommodate riders in a straddling position. The straddle seat 28 is sized to accommodate multiple riders. As seen in FIG. 2, the straddle seat 28 includes an operator seating portion 32 and a passenger seating portion 34. The straddle seat 28 is removable. A motor access opening is closed by a removable panel 29 to give access to the engine 22 and other components within the motor compartment 20. It is contemplated that the motor access opening could alternatively be defined by a top portion of the pedestal 30. A small storage box 36 is provided in front of the straddle seat 28. As seen in FIG. 1, a grab handle 38 is provided between the pedestal 30 and the rear of the seat 28 to provide a handle onto which a passenger may hold.

As best seen in FIG. 2, the PWC 10 has left and right generally upwardly extending walls known as gunwales or gunnels. A left gunnel 52 and a right gunnel 53 are located on either side of the PWC 10. In other words, the left gunnel 52 disposed on a left side of the pedestal 30 and the right gunnel 53 is disposed on a right side of the pedestal 30. Towards the rear of the PWC 10, the left gunnel 52 and the right gunnel 53 extend inwardly. A left foot-well 56 is disposed laterally between the pedestal 30 and the left gunnel 52 and a right foot-well 57 is disposed laterally between the pedestal 30 and the right gunnel 53 so that the left foot-well 56 and the right foot-well 57 can accommodate a rider's feet in various riding positions.

The left foot-well 56 has a front portion 1306, a central portion 1102 and a rear portion 1302. The front portion 1306 of the left foot-well 56 is longitudinally aligned with the steering assembly 62. The front portion 1306 extends forward and upward from the central portion 1102. The central portion 1102 of the left foot-well 56 is longitudinally aligned with the straddle seat 28 and is disposed rearward of the steering assembly 62. The central portion 1102 is also a longest straight portion of the left foot-well 56. The rear portion 1302 of the left foot-well 56 is disposed rearward of the central portion 1102. The rear portion 1302 of the left foot-well 56 extends upward and rearward from the central portion 1102 of the left foot-well 56.

The right foot-well 57 has a front portion 1308, a central portion 1104 and a rear portion 1304. The front portion 1308 of the right foot-well 57 is longitudinally aligned with the steering assembly 62. The front portion 1308 extends forward and upward from the central portion 1104. The central portion 1104 of the right foot-well 57 is longitudinally aligned with the straddle seat 28 and is disposed rearward of the steering assembly 62. The central portion 1104 of the right foot-well 57 is also a longest straight portion of the right foot-well 57. The rear portion 1304 of the right foot-well 57 is disposed rearward of the central portion 1104. The rear portion 1304 of the right foot-well 57 extends upward and rearward from the central portion 1102 of the right foot-well 57.

The deck 14 has a rear platform 58 provided at the rear of the PWC 10 at least in part rearward of the pedestal 30 to allow the operator or the passenger to easily reboard the PWC 10 from the water. As can be seen in FIG. 2, the rear platform 58 is connected to the left foot-well 56 on the left and to the right foot-well 57 on the right. Carpeting or some other suitable covering covers portions of the rear platform 58, the left foot-well 56 and the right foot-well 57.

Figure 3:
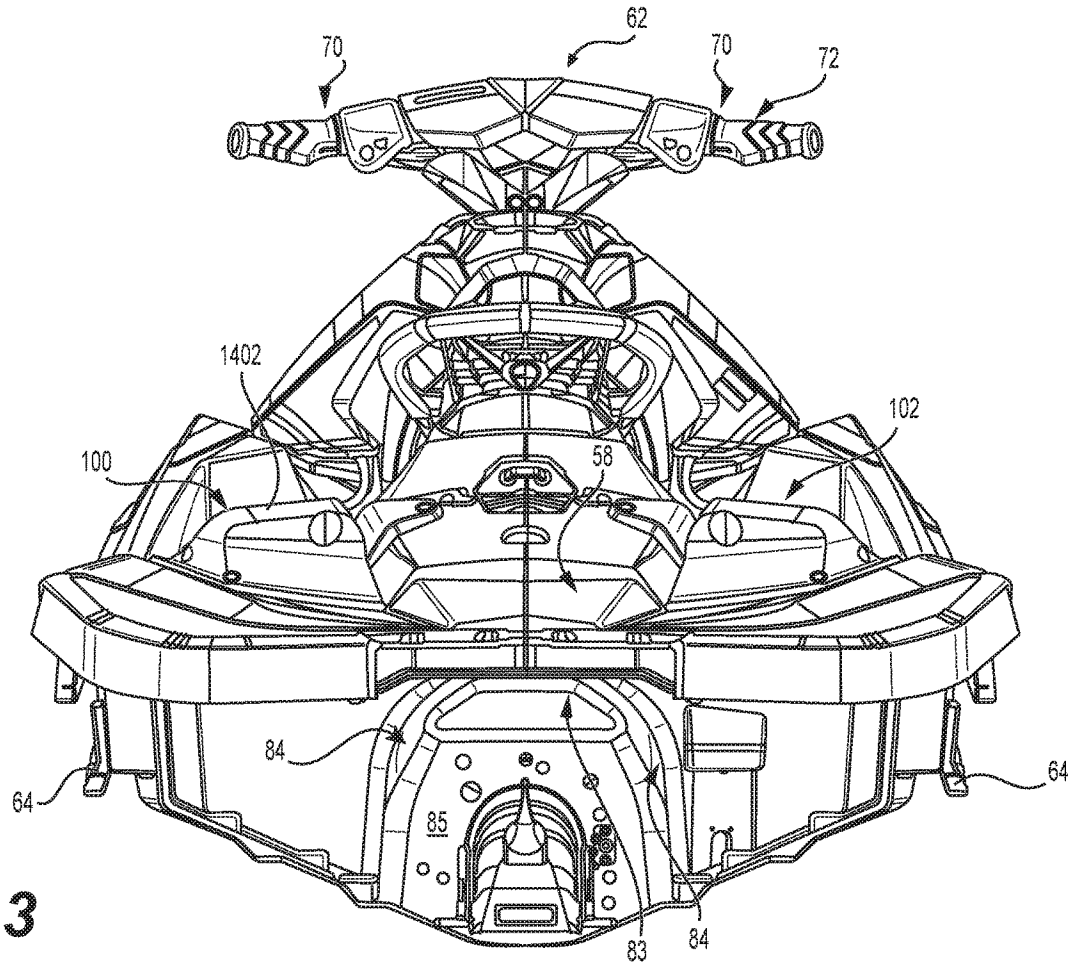
FIG. 3 is a rear plan view of the PWC of FIG. 1 with the jet propulsion system and the ride plate of the PWC removed.

As shown in FIG. 3, sponsons 64 are located on both sides of the hull 12. The sponsons 64 give the PWC 10 both lift while in motion and improved turning characteristics. The sponsons 64 are fixed to the surface of the hull 12 and are attached to the hull 12 by fasteners.

With reference to FIGS. 2 and 3, a steering assembly 62 is disposed in part forward of the straddle seat 28. The straddle seat 28 is disposed rearward of the steering assembly 62. The steering assembly has inter alia a handlebar 70. It is contemplated that any other type of steering assembly could be used, such as a steering wheel. The handlebar 70 is provided with a throttle lever 72 which allows the rider to control the speed of the PWC 10. Various components provided on or near the handlebar 70 allow the rider to change a condition of the PWC 10, such as speed, direction and trim (the pitch of the PWC 10).

Figure 4:
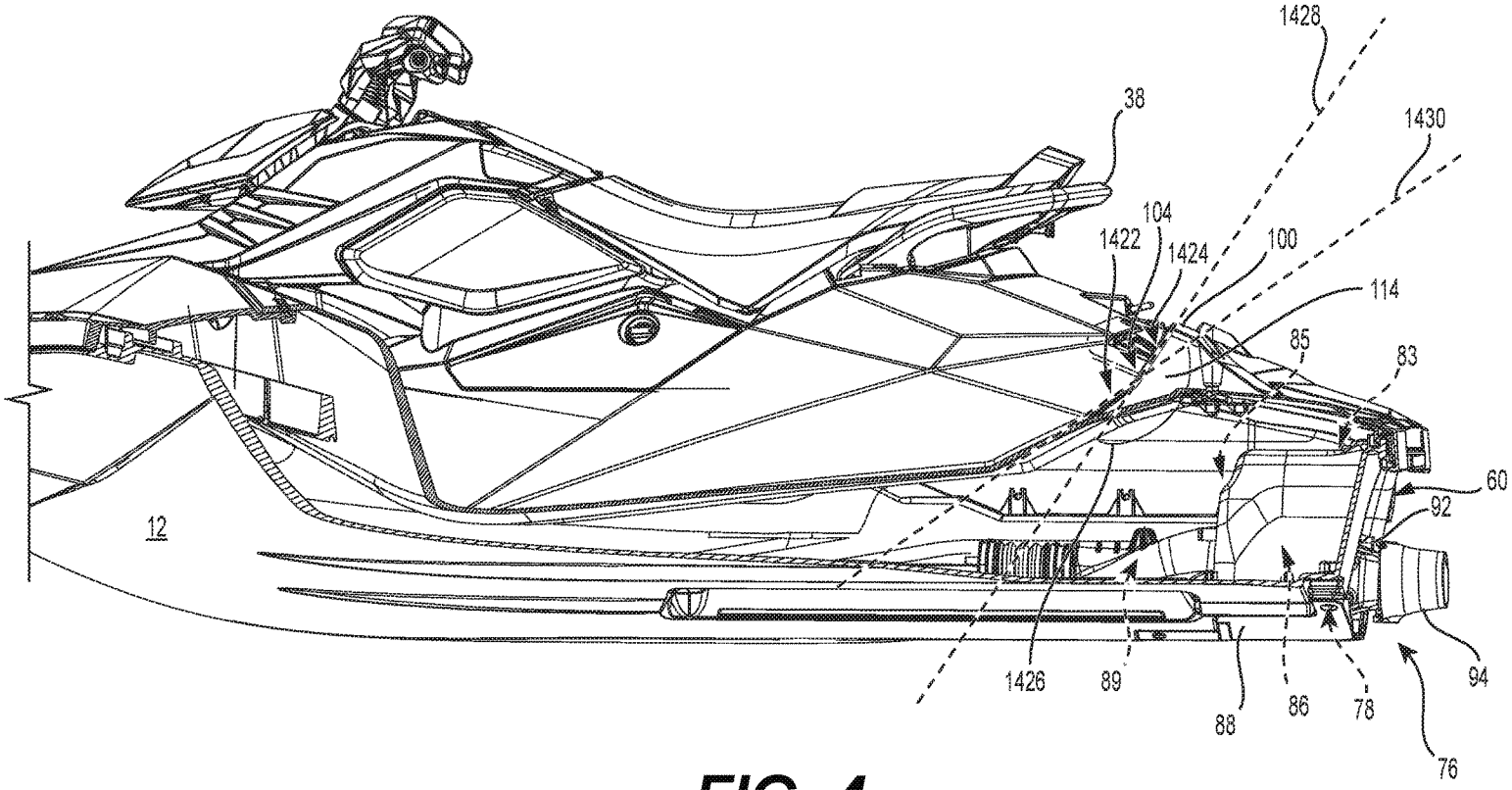
FIG. 4 is a partial cross-section of the PWC of FIG. 1 taken through line 4-4 of FIG. 2.

With reference to FIG. 4, the PWC 10 has a jet propulsion system 76 connected to the hull 12 and operatively connected to the engine 22 by a driveshaft (not shown). To that end, the jet propulsion system 76 includes a jet pump 78 operatively connected to the driveshaft. The steering assembly 62 is also operatively connected to the jet propulsion system 76. The jet pump 78 pressurizes water to create thrust. The jet pump 78 is connected to and is located in a formation in the hull 12, referred to as a tunnel 86. The hull 12 defines in part the tunnel 86.

With reference to FIGS. 3 and 4, the tunnel 86 is defined at the front by a front wall 85, on the sides by a pair of side walls 84, and at the top by a top wall 83 and is open at a stern 60. The front wall 85, the top wall 83 and the pair of side walls 84 are formed by the hull 12. The front wall 85 is disposed forward of a transom of the hull 12. The bottom of the tunnel 86 is closed by a ride plate 88. The ride plate 88 is connected to the hull 12 and defines a bottom wall of the tunnel 86. The ride plate 88 creates a surface on which the PWC 10 rides or planes at high speeds. The jet propulsion system 76 is disposed at least in part in the tunnel 86.

Figure 5:
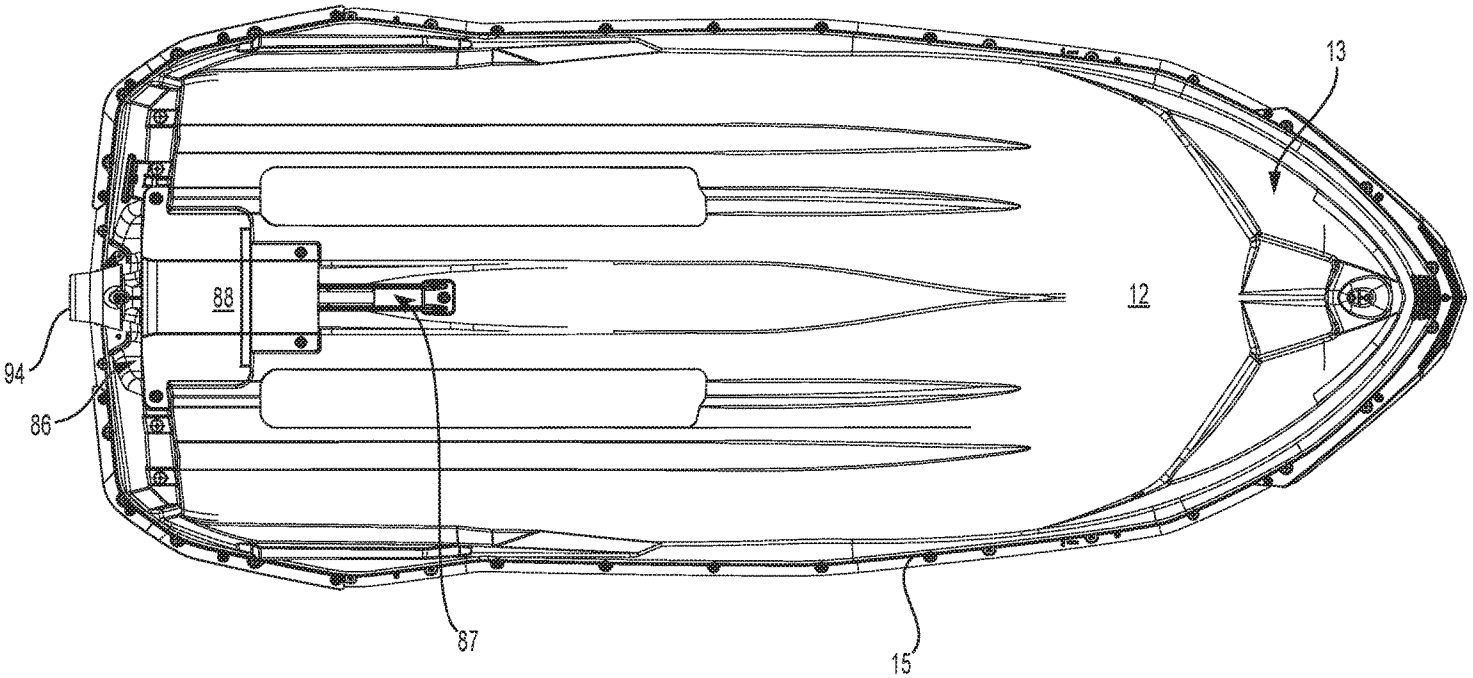
FIG. 5 is a bottom plan view of the PWC of FIG. 1.

As depicted in FIG. 5, the water enters the jet propulsion system 76 through a water inlet 87. The water is then conducted by a water intake ramp 89 (see FIG. 4) towards the jet pump 78 disposed in the tunnel 86. The water intake ramp 89 is disposed forward of the front wall 85 of the tunnel 86. Once the water leaves the jet pump 78, it goes through a venturi 92. Since the exit diameter of the venturi 92 is smaller than its entrance diameter, the water is accelerated further, thereby providing more thrust. A steering nozzle 94 is pivotally attached to the venturi 92 so as to rotate about a vertical axis (not shown). The steering nozzle 94 could also be supported at the exit of the tunnel 86 in other ways without a direct connection to the venturi 92. Moreover, the steering nozzle 94 could be replaced by a rudder or other diverting mechanism disposed at the exit of the venturi 92 to selectively direct the thrust generated by the jet pump 78 of the jet propulsion system to effect turning. Alternatively, rudders or other diverting mechanisms could be mounted to the stern 60 or other portion of the hull 12 to steer the PWC 10. The steering nozzle 94 is operatively connected to the steering assembly 62 via a push-pull cable (not shown) such that when the handlebar 70 is turned, the steering nozzle 94 pivots. This movement redirects the pressurized water coming from the venturi 92, so as to redirect the thrust and steer the PWC 10 in the desired direction. Optionally, the steering nozzle 94 may be gimbaled to allow it to move around a second horizontal pivot axis (not shown). The up and down movement of the steering nozzle 94 provided by this additional pivot axis is known as trim and controls the pitch of the PWC 10. It is contemplated that other types of propulsion systems, such as systems using propellers, could be used instead of the jet propulsion system 76.

Figure 6:
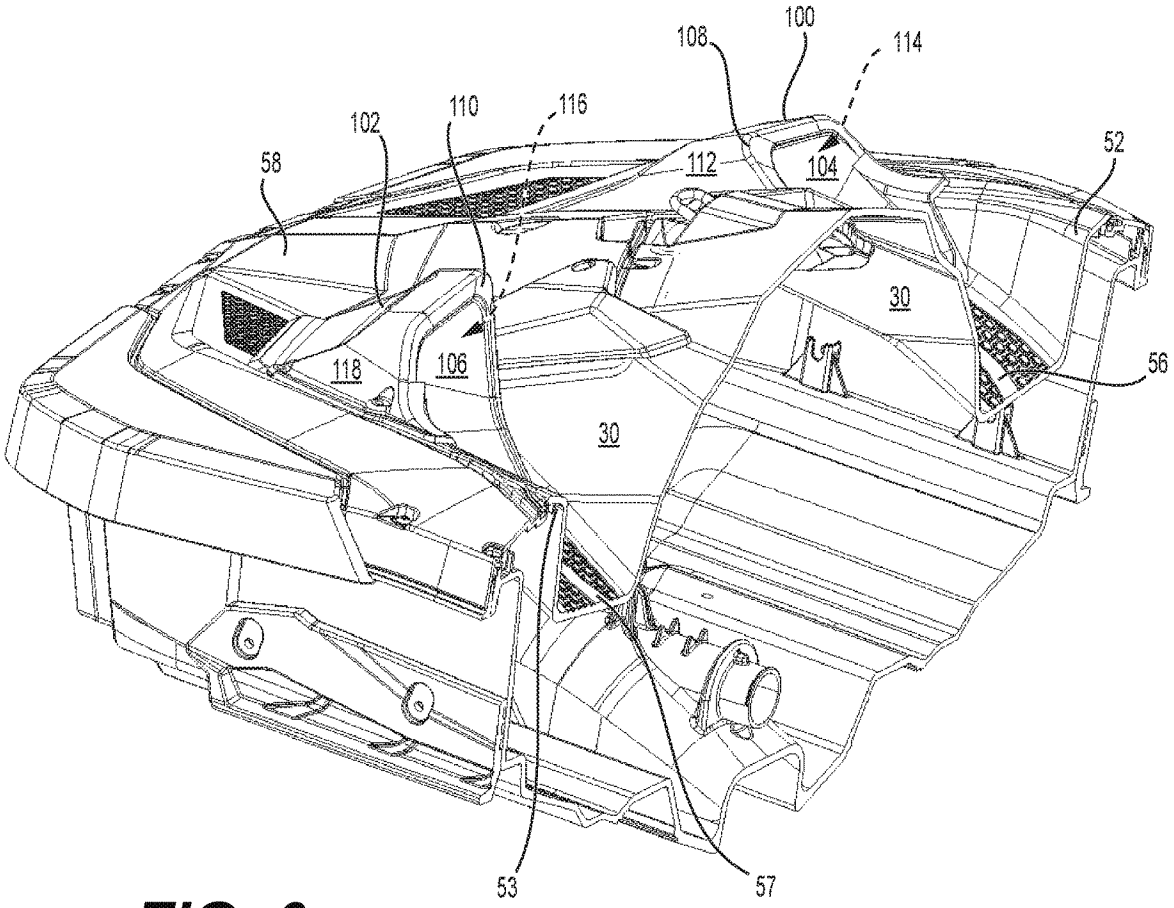
FIG. 6 is a perspective cross-section view of the PWC of FIG. 1 taken through line 6-6 of FIG. 2 with the internal components of the PWC removed.

With reference to FIGS. 2, 4 and 6, there is depicted a left footrest 100 comprising a left standing surface 104 facing substantially forward and extending forward of the tunnel 86. The left footrest 100 extends laterally between the pedestal 30 and the left gunnel 52. There is also depicted a right footrest 102 comprising a right standing surface 106 facing substantially forward and extending forward of the tunnel 86. The right footrest 102 extends laterally between the pedestal 30 and the right gunnel 53 as can be seen in FIG. 6. The left standing surface 104 comprises a left upper edge 108 and the right standing surface 106 comprises a right upper edge 110. The left upper edge 108 and the right upper edge 110 are disposed forward of the tunnel 86.

As best shown in FIG. 4, the left standing surface 104 and the right standing surface 106 are disposed entirely forward of the tunnel 86. In some embodiments of the present technology, the left standing surface 104 and the right standing surface 106 may be disposed at least in part forward of the rear platform 58. In other implementations, the left standing surface 104 and the right standing surface 106 may be longitudinally aligned with the front wall 85 of the tunnel 86.

Further, the left footrest 100 has a right vertically extending side 112 and a left vertically extending side 114. The right vertically extending side 112 is taller than the left vertically extending side 114. The right vertically extending side 112 extends at least partially along the pedestal 30.

Similarly, the right footrest 102 has a left vertically extending side 116 and a right vertically extending side 118. The left vertically extending side 116 is taller than the right vertically extending side 118. The left vertically extending side 116 extends at least partially along the pedestal 30.

As best shown in FIG. 2, the left standing surface 104 is disposed entirely laterally inward of the left gunnel 52 and the right standing surface 106 is disposed entirely laterally inward of the right gunnel 53. As can be seen in FIG. 4, the left standing surface 104 is longitudinally aligned with the water intake ramp 89. The right standing surface 106 is also longitudinally aligned with the water intake ramp 89. A front portion 1422 (depicted in FIG. 11) of the left standing surface 104 is longitudinally aligned with the water inlet 87 depicted in FIG. 5. A corresponding front portion of the right standing surface 106 is also longitudinally aligned with the water inlet 87 depicted in FIG. 5.

The left footrest 100 will now be described in further detail with reference to FIGS. 11 and 12. The right footrest 102 is a mirror image of the left footrest 100 and will, therefore, not be described in detail herein. The left footrest 100 is adapted for connection to the left foot-well 56 of the PWC 10. The left footrest 100 has a footrest body 1402 and a front face 1406 which defines the left standing surface 104. The footrest body 1402 has a base 1404 which is adapted for connecting the footrest body 1402 to the left foot-well 56. The base 1404 has screw holes 1420 for connecting the footrest body 1402 to the left gunnel 52 via screws (not depicted). In alternative embodiments, the base 1404 may be adapted for connecting the footrest body 1402 to the left foot-well 56 via adhesive, bolts, nails, rivets and/or any other suitable fastener.

Figure 11:
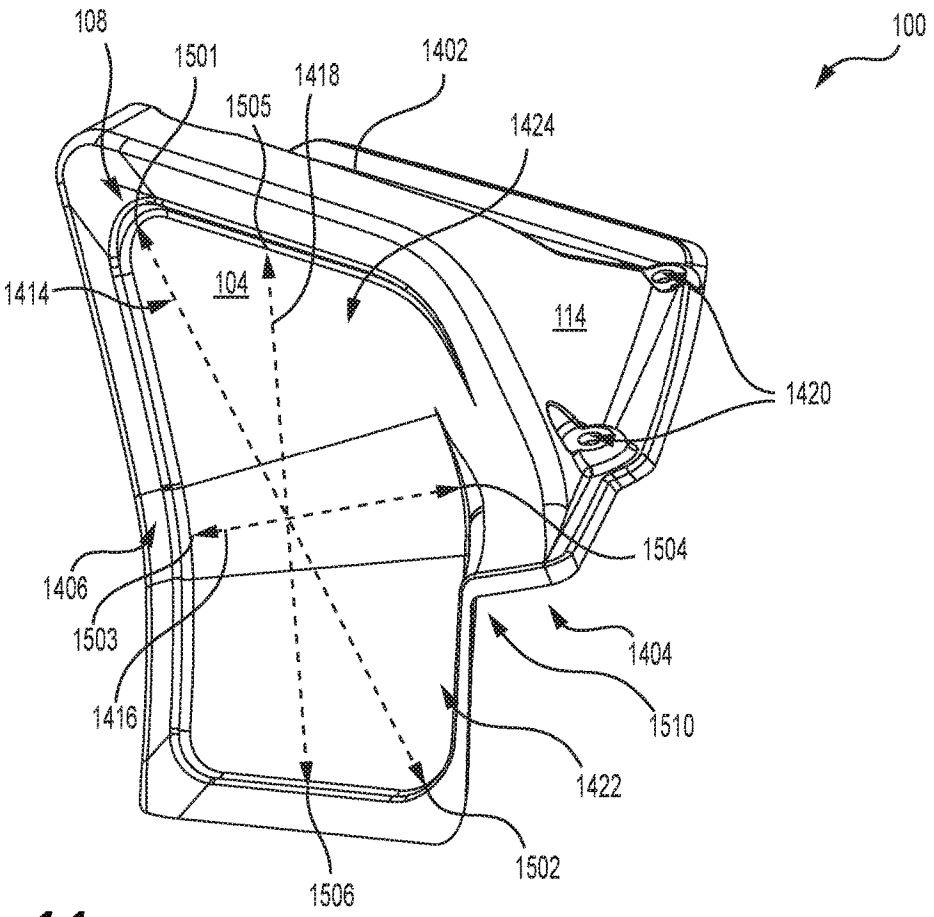
FIG. 11 is a perspective view taken from a front, left side of a left footrest of the PWC of FIG. 1.
Figure 12:
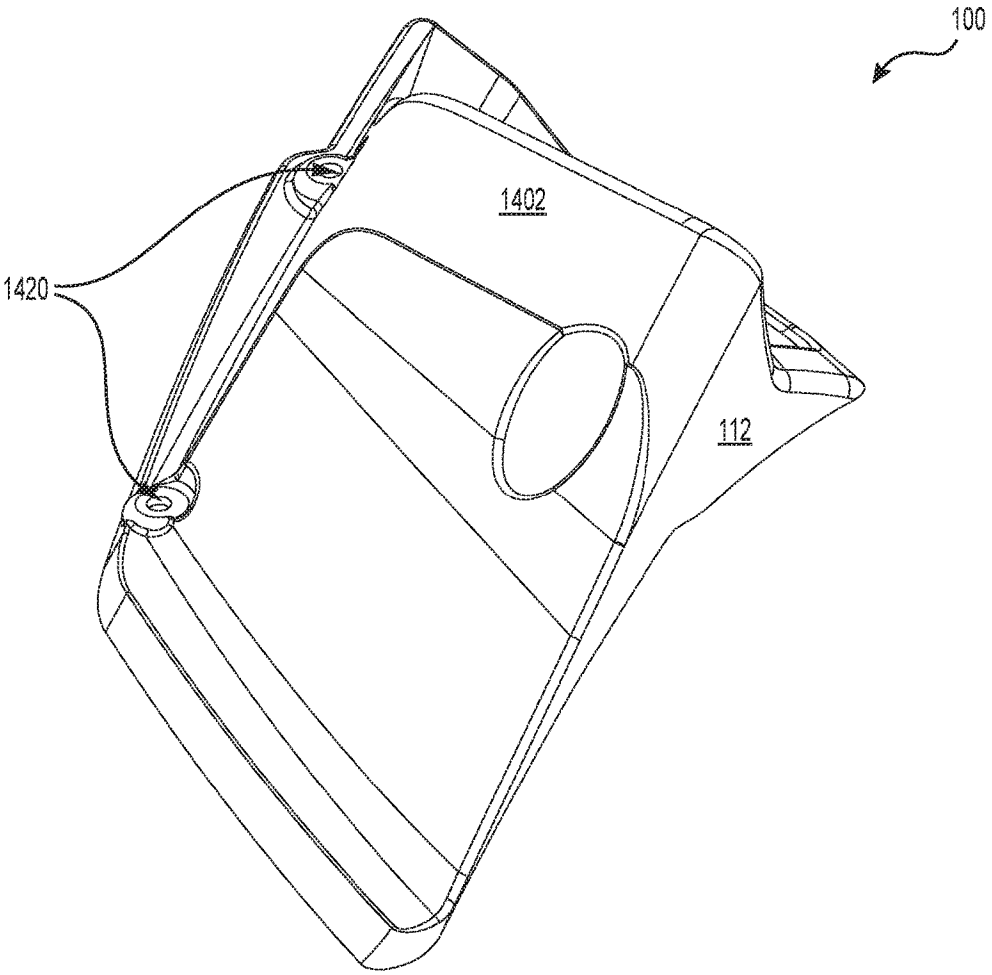
FIG. 12 is a perspective view taken from the rear, right side of the left footrest of FIG. 11.

As best seen on FIG. 11, the left standing surface 104 is a recessed portion of the front face 1406. The standing surface 104 can be covered with a carpeting material for providing more stability to the operator while standing on the left footrest 100. The front face 1406 is provided with a notch 1510 for receiving a portion of the left gunnel 52. It is contemplated that the standing surface 104 may not be recessed or that the standing surface 104 may comprise the entirety of the front face 1406.

The left standing surface 104 includes the front portion 1422 and a rear portion 1424. As best seen on FIG. 4, the front portion 1422 of the left standing surface 104 and the rear portion 1424 of the left standing surface 104 are disposed at an angle 1426 to each other. The angle 1426 is an angle between a line 1428, which extends through a point 1505 at a lateral center of the top of the left standing surface 104 (see FIG. 11) and the center of the left standing surface 104, and a line 1430, which extends through the center of the left standing surface 104 and a point 1506 at a lateral center of the bottom of the left standing surface 104 (see FIG. 11). In the example depicted in FIG. 4, the angle 1426 is 160 degrees. In other embodiments, the angle 1426 is between 145 and 180 degrees. As would be understood, in the embodiments where the angle 1426 is 180 degrees, the left standing surface 104 is flat. As can be seen in FIG. 4, providing the front portion 1422 at the angle 1426 to the rear portion 1424 allows a better transition between the rear portion 1302 of the foot-well 56 and the rear portion 1424 of the left standing surface 104.

As previously mentioned, the footrest body 1402 includes the right vertically extending side 112 and the left vertically extending side 114. The left vertically extending side 114 is disposed opposite to the right vertically extending side 112. The right vertically extending side 112 extends at least in part laterally outwardly from the base 1404. It should be noted that the right vertically extending side 112 and the left vertically extending side 114 are generally triangular as it can be seen in FIGS. 11 and 12.

The left standing surface 104 has a largest straight diagonal dimension 1414. More precisely, the largest straight diagonal dimension 1414 is a measurement of a longest three-dimensional straight line separating a point 1501 at the top right edge of the left standing surface 104 and a point 1502 at the bottom left edge of the left standing surface 104. In one example, as depicted in FIG. 11, the largest straight diagonal dimension 1414 is 0.22 meters. In some embodiments, the largest straight diagonal dimension 1414 is between 0.2 meters and 0.25 meters.

The left standing surface 104 has a straight line width 1416 measured through a center of the left standing surface 104. More precisely, the straight line width 1416 is a measurement of a longest three-dimensional straight line separating a point 1503 at a longitudinal center of the left side of the left standing surface 104 and a point 1504 at a longitudinal center of the right side of the left standing surface 104. In one example, the straight line width 1416 is 0.102 meters. In other implementations, the straight line width 1416 is between 0.075 meters and 0.125 meters.

Moreover, the left standing surface 104 has a straight line length 1418 measured through the center of the left standing surface 104. More precisely, the straight line length 1418 is a measurement of a longest three-dimensional straight line separating the point 1505 and the point 1506. In one example, the straight line length 1418 is 0.174 meters. In alternative embodiments, the straight line length 1418 is between 0.15 meters and 0.19 meters.

In one example, the left standing surface 104 has a planar surface area (not shown) of about 0.01775 square meters. In this case, the planar surface area is measured on a plane which extends through the points 1503, 1504, 1505 and 1506. In some embodiments, the planar surface area is between 0.01125 square meters and 0.02375 square meters.

Figure 7:
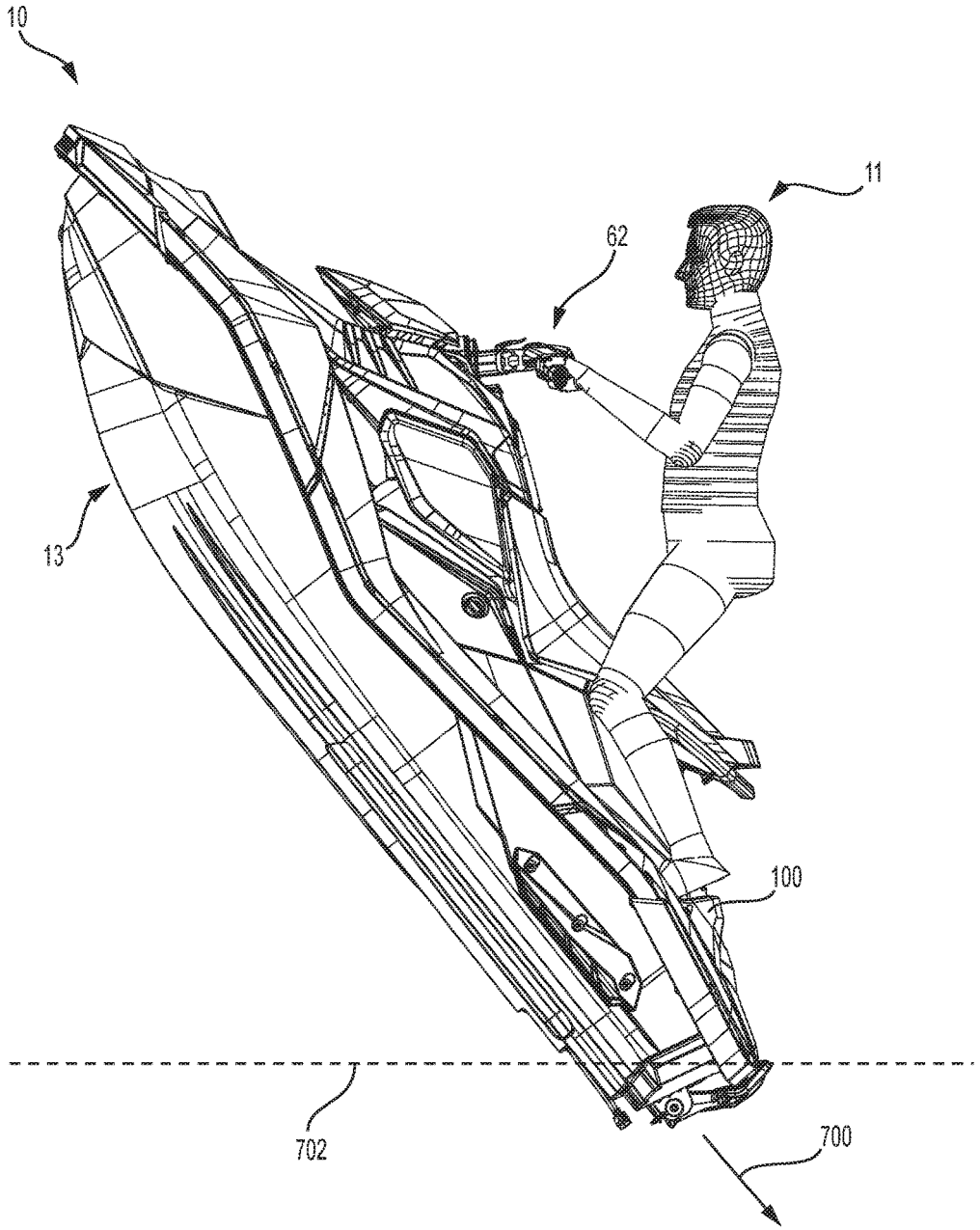
FIG. 7 is a left side elevation view of the PWC of FIG. 1 being operated by a skilled operator performing a trick.

When riding the PWC 10, as depicted in FIG. 7, a skilled operator 11 can pull a bow 13 of the PWC 10 out of the water, orienting the PWC 10 almost vertically such that a thrust 700 of the jet pump 78 is directed generally downwards and all but the stern 60 of the PWC 10 is lifted out of the water. It should be noted that line 702 in FIG. 7 is a line parallel to the water level. The skilled operator 11 can keep the PWC 10 in such a position for an extended period of time, leaning the PWC 10 forward just enough to maintain a substantially vertical position while travelling forward or turning. The left footrest 100 and the right footrest 102 enable the skilled operator 11 to achieve this trick more comfortably and to perform new tricks with the PWC 10. The left standing surface 104 and the right standing surface 106 are large enough to accommodate almost entirely the feet of the skilled operator 11. In some embodiments, the left standing surface 104 and the right standing surface 106 are large enough to accommodate entirely the feet of the skilled operator 11.

When the PWC 10 is in the position depicted in FIG. 7, the left standing surface 104 and the right standing surface 106 are generally horizontal, i.e. parallel with the line 702, which allows the skilled operator 11 to keep the PWC 10 in this position with more ease. In this position of the PWC 10, the weight of the skilled operator 11 is applied on his feet since the skilled operator 11 is standing on the left standing surface 104 and the right standing surface 106 and not sitting on the straddle seat 28. Moreover, the feet and lower legs of the skilled operator 11 are at generally right angles to one another, which increases comfort. In contrast, an operator attempting the same trick on a conventional watercraft without the left and right footrests 100 and 102 would have to support themselves with the rear portions 1302 of the left foot-well 56 and the rear portion 1304 of the right foot-well 57 resulting in an acute angle between the feet and lower legs of the operator 11. Also, the arms of the skilled operator 11 are bent at approximately 90 degrees while holding the handlebar 70 of the steering assembly 62 which is a generally comfortable position. It should be noted that the skilled operator 11 illustrated in FIG. 7 is a $50^{th}$ percentile male and is generated from "CATIA Human Builder modelling system".

Figure 8:
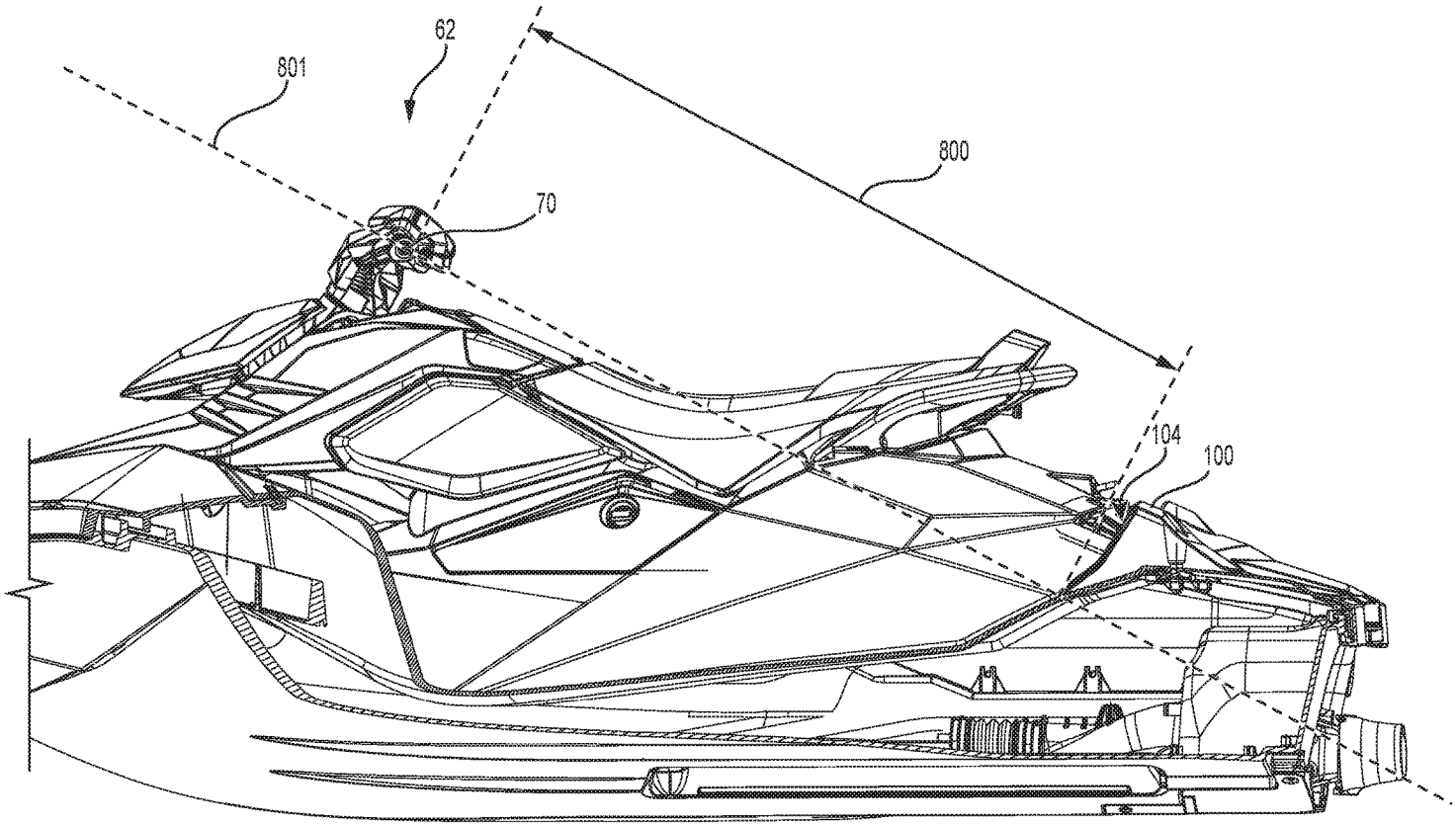
FIG. 8 is a partial cross-section of the PWC of FIG. 1 taken through line 4-4 of FIG. 2 showing some geometric features of the PWC.
Figure 9:
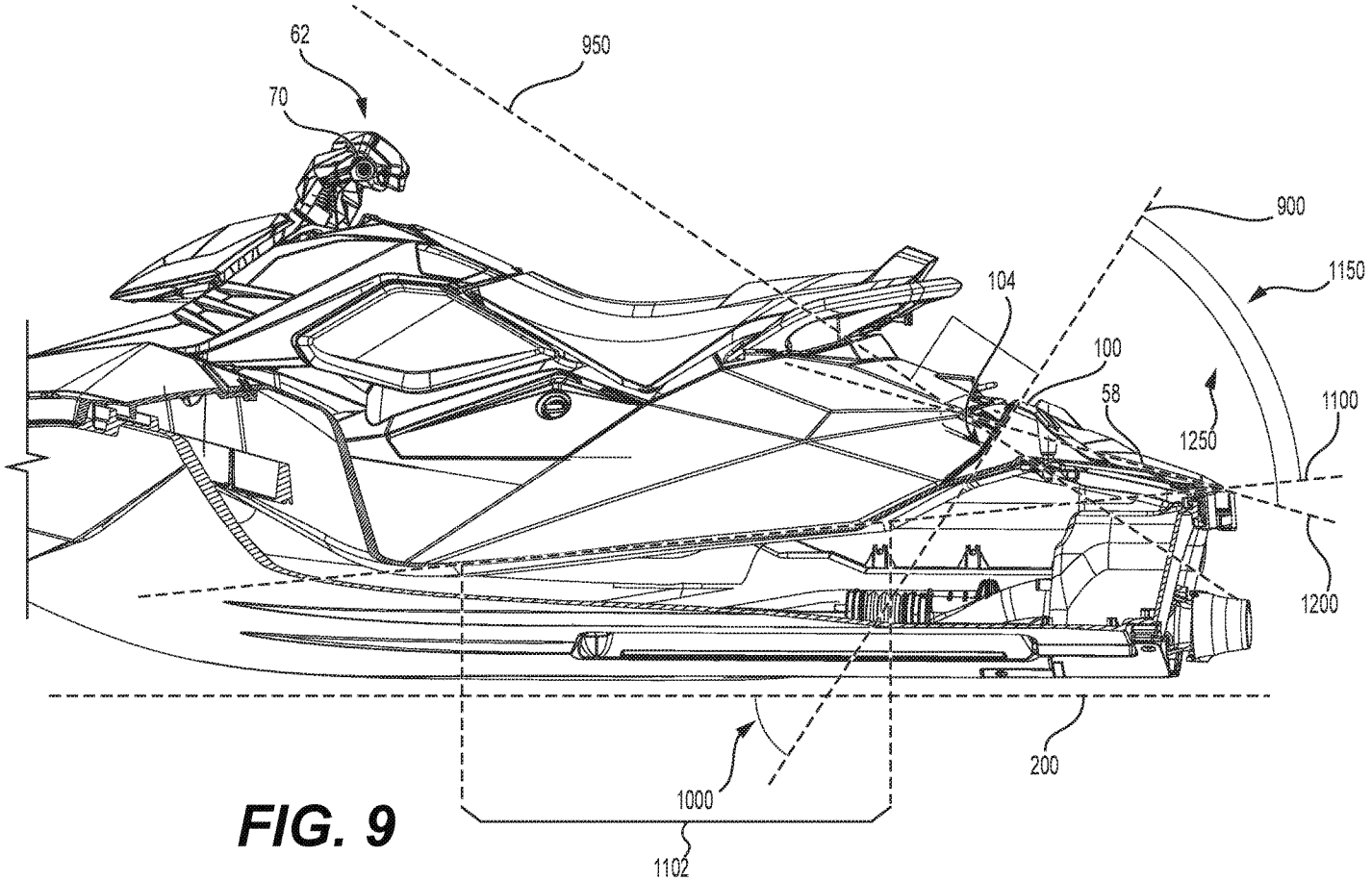
FIG. 9 is a partial cross-section of the PWC of FIG. 1 taken through line 4-4 of FIG. 2 showing other geometric features of the PWC.
Figure 10:
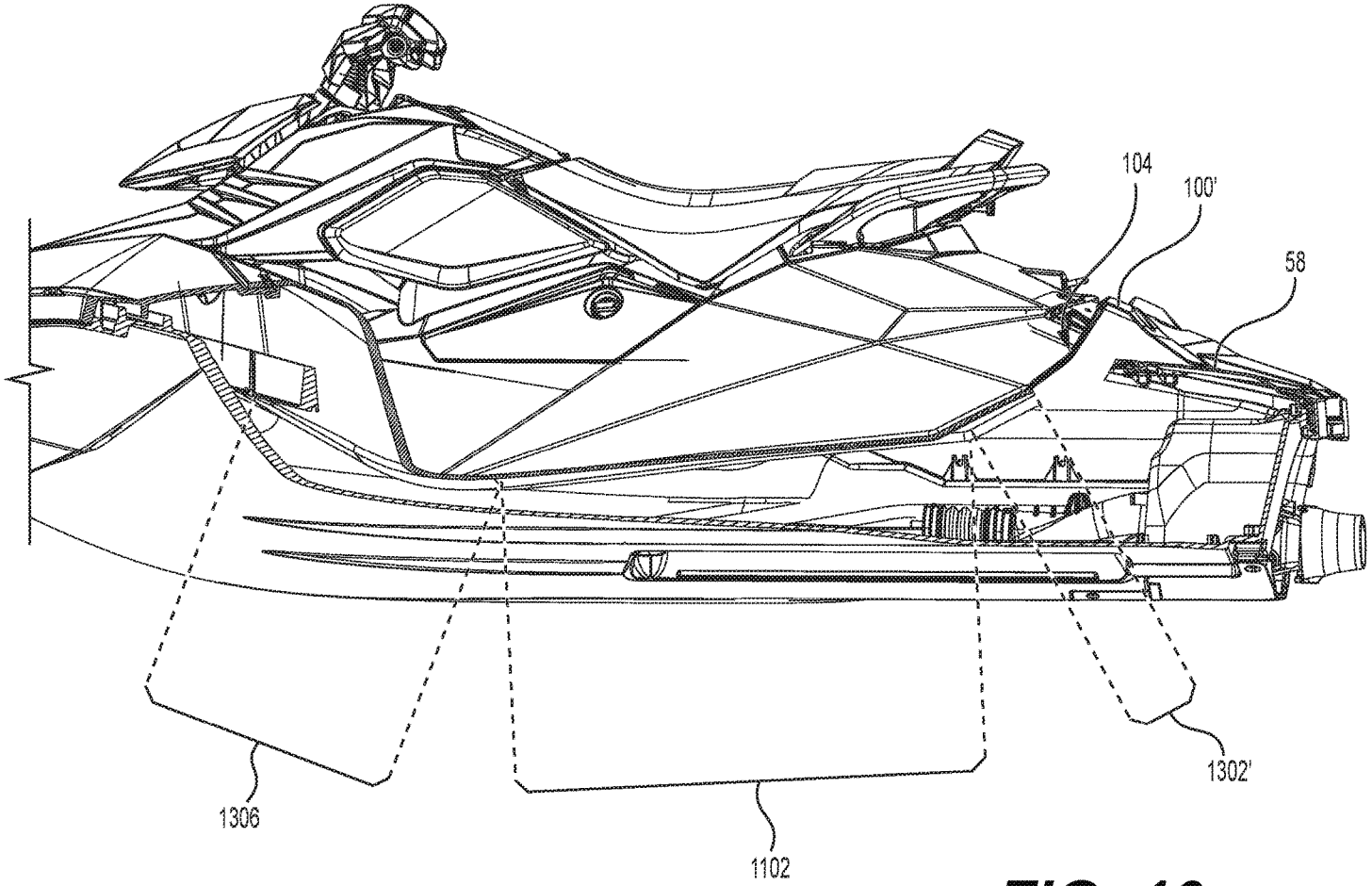
FIG. 10 is a partial cross-section of the PWC of FIG. 1 taken through line 4-4 of FIG. 2 showing an alternative implementation of the footrests.

Additional details regarding positions, dimensions and orientations of the left footrest 100 and the right footrest 104, as well as features thereof, will now be provided with respect to FIGS. 8 to 10. As previously mentioned, the right footrest 102 is a mirror image of the left footrest 100. Therefore, only the positions, the dimensions and the orientations of the left footrest 100 as well as features thereof will be provided for the sake of simplicity.

With reference to FIGS. 2 and 8, there is depicted inter alia a distance 800 between the handlebar 70 of the steering assembly 62 and the left footrest 100. The distance 800 is measured along a line 801 extending downward and rearward from the handlebar 70 to the front of the left footrest 100, wherein the line 801 is parallel to a vertical plane (not shown) passing through a longitudinal centerline of the PWC 10. In some embodiments of the present technology, the distance 800 is between 1.2 meters and 1.4 meters. In other embodiments, the distance 800 is about 1.3 meters. In one example and as depicted in FIG. 8, the distance 800 is 1.315 meters which may provide the skilled operator 11 with enough room for an adequate body position while performing the trick with the PWC 10 depicted in FIG. 7.

FIG. 9 depicts inter alia a line 950 normal to the left standing surface 104 at a center thereof. The line 950 is normal to a line 900 which is parallel to the rear portion 1424 of the left standing surface 104 and the line 950 extends through the center of the left standing surface 104. As can be seen, the line 950 extends above the steering assembly 62. It should be noted that positioning the left footrest 100 and the left standing surface 104 such that the line 950 extends above the steering assembly 62 allows an easier lifting of the bow 13 of the PWC 10 out of the water by the skilled operator 11 for positioning the PWC 10 as shown in FIG. 7.

There is also depicted a line 200 which is parallel to the water line. More precisely, the water line is a line where the hull 12 of the PWC 10 meets the water when the PWC 10 is buoyantly floating on the water. In one example and as depicted in FIG. 9, the angle 1000 between the line 200 and the line 900 is 59.5 degrees. In some embodiments of the present technology, an angle 1000 between the line 900 and the waterline is between 45 degrees and 70 degrees. In other embodiments, the angle 1000 is about 60 degrees.

FIG. 9 also depicts a line 1100 which is parallel to a central portion 1102 of the left foot-well 56. In some embodiments of the present technology, the angle 1150 between the line 900 and the line 1100 is between 35 degrees and 65 degrees. In one example, such as depicted in FIG. 9, the angle 1150 is 52.9 degrees. Further, a line 1200 is also depicted in FIG. 9 which is parallel to the rear platform 58. In some embodiments of the present technology, the angle 1250 between the line 900 and the line 1200 is between 65 degrees and 90 degrees. In one example, such as depicted in FIG. 9, the angle 1250 is 81.7 degrees.

FIG. 10 depicts an alternative embodiment of the present technology wherein a left footrest 100' is integrally formed by the deck 14 of the PWC 10. There is depicted inter alia the central portion 1102 of the left foot-well 56 and a rear portion 1302' of the left foot-well 56. In this case, the left footrest 100' is disposed longitudinally between the rear portion 1302' of the left foot-well 56 and the rear platform 58. The left standing surface 104 extends rearward and upward from the rear portion 1302'.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A personal watercraft comprising:

a hull defining at least in part a tunnel, the tunnel having a pair of side walls, a front wall and a top wall defined by the hull, the front wall being disposed forward of a transom of the hull;

a ride plate connected to the hull, the ride plate defining a bottom wall of the tunnel;

a motor supported by the hull;

a jet propulsion system connected to the hull and operatively connected to the motor, the jet propulsion system being disposed at least in part in the tunnel;

a steering assembly operatively connected to the jet propulsion system;

a deck disposed on the hull, the deck including:

a pedestal;

a left gunnel disposed on a left side of the pedestal;

a right gunnel disposed on a right side of the pedestal;

a left foot-well disposed laterally between the pedestal and the left gunnel;

a right foot-well disposed laterally between the pedestal and the right gunnel; and a rear platform disposed at least in part rearward of the pedestal;

a straddle seat disposed on the pedestal and at least in part rearward of the steering assembly;

a left footrest comprising a left standing surface, the left standing surface facing substantially forward and extending at least partially forward of the tunnel, the left footrest extending laterally between the pedestal and the left gunnel; and a right footrest comprising a right standing surface, the right standing surface facing substantially forward and extending at least partially forward of the tunnel, the right footrest extending laterally between the pedestal and the right gunnel.

2. The personal watercraft of claim 1, wherein a longest distance between a handlebar of the steering assembly and one of the left footrest and the right footrest is between 1.2 meters and 1.4 meters, the longest distance being measured along a line extending downward and rearward from the handlebar to the one of the left footrest and the right footrest, the line being parallel to a vertical plane passing through a longitudinal centerline of the watercraft.

3. The personal watercraft of claim 2, wherein the longest distance is about 1.3 meters.

4. The personal watercraft of claim 1, wherein a first line normal to the left standing surface at a center thereof and a second line normal to the right standing surface at a center thereof extend above the steering assembly.

5. The personal watercraft of claim 1, wherein the left standing surface comprises a left upper edge and the right standing surface comprises a right upper edge, the left upper edge and the right upper edge being disposed forward of the tunnel.

6. The personal watercraft of claim 5, wherein the left standing surface and the right standing surface are disposed entirely forward of the tunnel.

7. The personal watercraft of claim 1, wherein the left footrest has a right vertically extending side and a left vertically extending side, the right vertically extending side being taller than the left vertically extending side, the right vertically extending side of the left footrest extending along the pedestal; and wherein the right footrest has a right vertically extending side and a left vertically extending side, the left vertically extending side being taller than the right vertically extending side, the left vertically extending side of the right footrest extending along the pedestal.

8. The personal watercraft of claim 1, wherein the left standing surface is disposed entirely laterally inward of the left gunnel and the right standing surface is disposed entirely laterally inward of the right gunnel.

9. The personal watercraft of claim 1, wherein the left standing surface and the right standing surface are longitudinally aligned with a water intake ramp, the water intake ramp being disposed forward of the front wall of the tunnel.

10. The personal watercraft of claim 1, wherein at least a portion of the left standing surface and at least a portion of the right standing surface are longitudinally aligned with a water inlet.

11. The personal watercraft of claim 1, wherein the left standing surface and the right standing surface are at an angle between 45 degrees and 70 degrees from a waterline.

12. The personal watercraft of claim 11, wherein the angle is of about 60 degrees.

13. The personal watercraft of claim 1, wherein the left standing surface and the right standing surface are at an angle of between 65 degrees and 90 degrees from the rear platform.

14. The personal watercraft of claim 1, wherein left standing surface is at an angle between 35 degrees and 65 degrees from a central portion of the left foot-well; and wherein the right standing surface is at an angle between 35 degrees and 65 degrees a central portion of the right foot-well.

15. The personal watercraft of claim 1, wherein the left standing su and the right standing surface are disposed at least in part forward of the rear platform.

16. The personal watercraft of claim 1, wherein:

the left foot-well has a central portion and a rear portion, the rear portion extends upward and rearward from the central portion to the left footrest;

the left standing surface is disposed longitudinally between the rear portion of the left foot-well and the rear platform;

the tight foot-well has a central portion and a rear portion, the rear portion extends upward and rearward from the central portion to the right footrest; and the right standing surface is disposed longitudinally between the rear portion of the right foot-well and the rear platform.

17. A footrest for a personal watercraft, the footrest being adapted for connection to a foot-well of the personal watercraft, the footrest comprising:

a footrest body having a base adapted for connecting the footrest body to the foot-well and a front face defining a standing surface, the footrest body having a first vertically extending side and a second vertically extending side, the second vertically extending side being disposed opposite to the first vertically extending side, the first vertically extending side being taller than the second vertically extending side, the first vertically extending side extending at east in part laterally from the base, and the first vertically extending side and the second vertically extending side being generally triangular.

18. The footrest of claim 17, wherein the standing surface has a largest straight diagonal dimension between 0.2 meters and 0.25 meters.

19. The footrest of claim 17, wherein the standing surface has a straight line width between 0.075 meters and 0.125 meters measured through a center thereof.

20. The footrest of claim 17, wherein the standing surface has a straight line length between 0.15 meters and 0.19 meters measured through a center thereof.

* * * * *